US008783502B2

(12) United States Patent
Sele et al.

(10) Patent No.: US 8,783,502 B2
(45) Date of Patent: Jul. 22, 2014

(54) SUPPORTS ANCHORED WITH RIBS

(75) Inventors: Arne Barrett Sele, Hosle (NO); Trygve Johannes Lund, Oslo (NO)

(73) Assignee: Aker Engineering & Technology AS, Lysaker (NO)

( * ) Notice: Subject to any disclaimer, the term of this patent is extended or adjusted under 35 U.S.C. 154(b) by 10 days.

(21) Appl. No.: 13/505,279

(22) PCT Filed: Oct. 29, 2010

(86) PCT No.: PCT/NO2010/000389

§ 371 (c)(1),
(2), (4) Date: Sep. 18, 2012

(87) PCT Pub. No.: WO2011/053156

PCT Pub. Date: May 5, 2011

(65) Prior Publication Data

US 2013/0126535 A1 May 23, 2013

(30) Foreign Application Priority Data

Oct. 29, 2009 (NO) ..... 20093246
Jul. 2, 2010 (NO) ..... 20100971

(51) Int. Cl.
*B65D 90/12* (2006.01)

(52) U.S. Cl.
USPC ..... 220/560.07; 220/560.11; 220/562; 220/628; 220/636; 114/74 T; 114/74 A

(58) Field of Classification Search
USPC ..... 220/560.05, 560.07, 560.1–560.11, 220/562, 628, 630, 636, 638, 901
IPC ..... B65D 90/12
See application file for complete search history.

(56) References Cited

U.S. PATENT DOCUMENTS

| | | | | |
|---|---|---|---|---|
| 2,905,352 | A | 9/1959 | Henry | |
| 3,071,094 | A * | 1/1963 | Lcroux | 220/901 |
| 3,312,076 | A * | 4/1967 | Clarke et al. | 62/45.1 |
| 3,530,630 | A * | 9/1970 | Wilhelm | 52/410 |
| 3,800,970 | A * | 4/1974 | Jackson | 220/560.08 |
| 3,830,396 | A * | 8/1974 | Jackson | 220/560.07 |
| 3,894,505 | A | 7/1975 | Murphy | |
| 4,013,030 | A * | 3/1977 | Stafford | 114/74 A |
| 4,156,492 | A * | 5/1979 | Cavanna et al. | 220/560.1 |
| 5,445,096 | A * | 8/1995 | Aoki et al. | 114/74 A |
| 5,531,178 | A | 7/1996 | Abe et al. | |
| 6,971,537 | B2 * | 12/2005 | Enright, Jr. | 220/560.08 |
| 2003/0015529 | A1 * | 1/2003 | Przytulla | 220/23.91 |
| 2003/0057214 | A1 * | 3/2003 | Miller et al. | 220/565 |

FOREIGN PATENT DOCUMENTS

| | | |
|---|---|---|
| CN | 201221675 | 4/2009 |
| DE | 1781041 | 10/1968 |
| FR | 1508582 | 1/1968 |

OTHER PUBLICATIONS

International Search Report for International Application No. PCT/NO2010/000389—Date of Completion, Jan. 11, 2011, 2 pages.
Norwegian Search Report for Norwegian App No. 20100971—Date of report, Sep. 22, 2010, 2 pages.

* cited by examiner

*Primary Examiner* — Mickey Yu
*Assistant Examiner* — Brijesh V. Patel
(74) *Attorney, Agent, or Firm* — Locke Lord LLP

(57) ABSTRACT

A tank subjected to thermal expansion and contraction, comprising a support block in contact with the bottom of the tank, where the support block and the bottom of the tank are connected by a rib in either the bottom of the tank or the support block, where the rib is in a groove in either the bottom of the tank or the support block to prevent horizontal movement of the tank.

5 Claims, 3 Drawing Sheets

SUPPORTS ANCHORED WITH RIBS

FIELD OF INVENTION

The present invention relates to tanks for storage and transportation of fluids such as hydrocarbons, including low temperature liquefied natural gas. This includes tanks for ships and floating offshore structures exposed to wave loads as well as gravity based offshore structures and land tanks exposed to earthquakes.

BACKGROUND OF THE INVENTION

Tanks may be designed in many different configurations, such as spheres, cylinders, cones and shells in general, as well as prismatic shapes. The principal advantage of prismatic shapes is that they nest closer to each other, minimising the volume taken up by such tanks.

Such tanks may be supported by timber of various types or similar materials. The present technology for anchoring such supports to the bottom of the tank is to weld on guide rails. For certain materials welds have considerably lower strength then the base metal which prevents full utilisation of the base metal. Welds are also more susceptible to fatigue. To avoid initiating cracks propagating from welds and propagating through the thickness of the shell the design is such that there are no welds in the webs of the H-beams making up the panels.

U.S. Pat. No. 5,531,178 discloses a support structure for LNG tanks. The bottom supports are restrained by guide rails. No description of how these guide rails are fastened to the bottom of the tank is provided.

WO 2008/133785 discloses a tank for transportation of LNG. The supports between the bottom of the tank and the floor of the ship hull are only described as "support chocks", and there is no mention of how, or if, the supports are anchored to the tank.

OBJECT OF THE INVENTION

The object of the present invention is to provide supports for tanks which avoid the problems regarding welds described above.

SUMMARY OF THE INVENTION

The object of the present invention is obtained by anchoring the support blocks into welded box shaped containers with a groove matching the rib in the tank bottom or vice versa. This avoids welding onto the bottom structure of the tank. For certain materials welds have inferior strength. Welds are also far more susceptible to fatigue cracks which may propagate through thickness leading to leaks. Base metal is far less susceptible to fatigue and crack propagation. The invention is further defined by the following:

A support arranged at the bottom of a tank subjected to thermal expansion and contraction, comprising a block in contact with the bottom of the tank, means being arranged to prevent movement at the tank with respect to the block in a horizontal direction, wherein said means comprises a rib arranged in one of said bottom of the tank and block and a corresponding groove in the other said bottom and block.

In one embodiment of the present invention, the above-mentioned rib is depending from the bottom of the tank and is extending into a groove in the block.

In one embodiment of the present invention, the above-mentioned rib is extending from block into a groove in the bottom of the tank.

In one embodiment of the present invention, the above-mentioned rib forms part of an element of the bottom of the tank having welds to adjoining elements spaced from the rib.

In one embodiment of the present invention, the above-mentioned rib is a rolled or extruded part of the bottom.

BRIEF DESCRIPTION OF THE DRAWINGS

Further details of the invention will be described below with reference to the exemplifying embodiments shown schematically in the appended drawings, wherein.

DETAILED DESCRIPTION OF THE DRAWINGS

Figure 1:
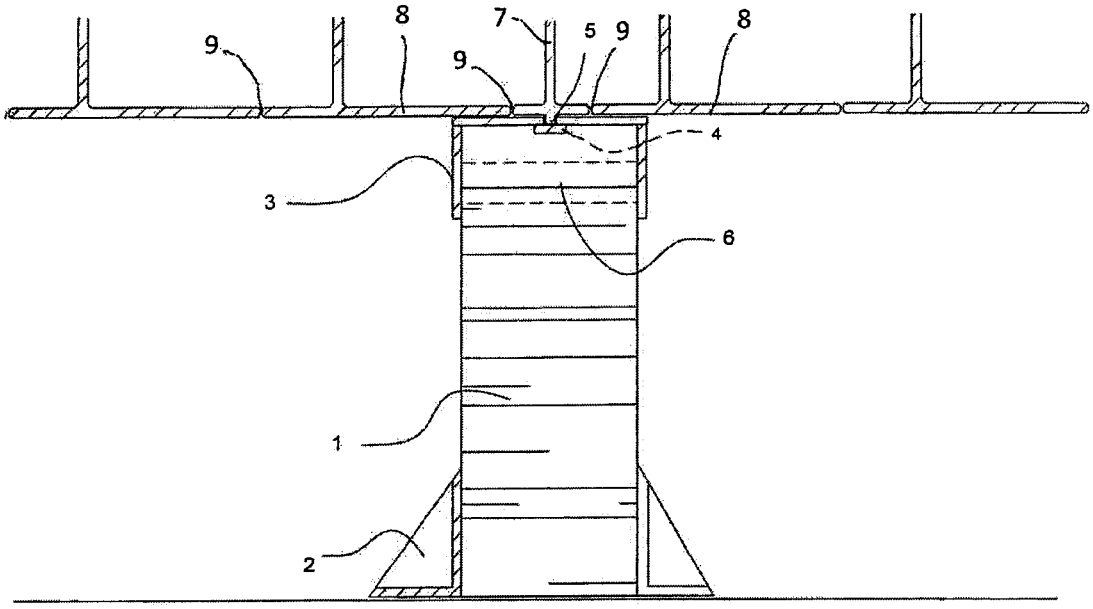
FIG. 1 shows a cross section of a support.

FIG. 1 shows a cross section of a support. The support block 1 is made from timber, laminated timber or other suitable material. The supports are constrained by rails 2 welded to the hull. The top part of the support block is confined inside a box 3 assembled from plate including a bracket 6. The box includes a groove 4 into which a rib 5 may be anchored. The rib 5 may be rolled or extruded as part of the plate or cross section making up the bottom structure of the tank. This provides a base metal structural detail preventing the need for welding onto the bottom of the tank.

The bottom of the tank comprises two different types of elements 7, 8 which are jointed together by welds 9. A first element 7 is resting on the support block 1, and so are the areas of the weld 9 joining the first element 7 to the adjoining second element 8. The lower portion of the first element 7 contains the rib 5 as an integral part. This lower portion is symmetrical about a central vertical plan perpendicular to the drawing, and the rib 5 is equidistant from the welds of the first element 7.

Figure 2:
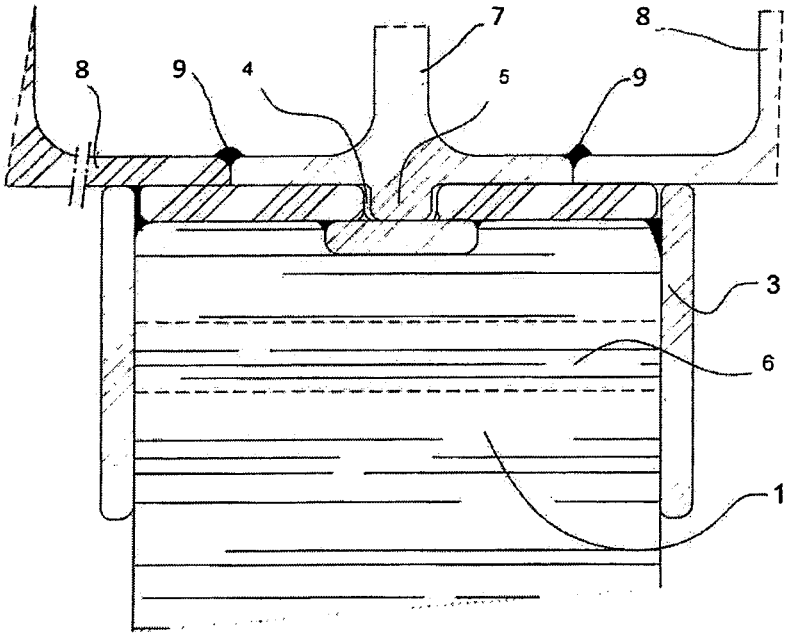
FIG. 2 shows a detail of the cross section in FIG. 1.

FIG. 2 shows the detail around the rib 5 and groove 4.

Figure 3:
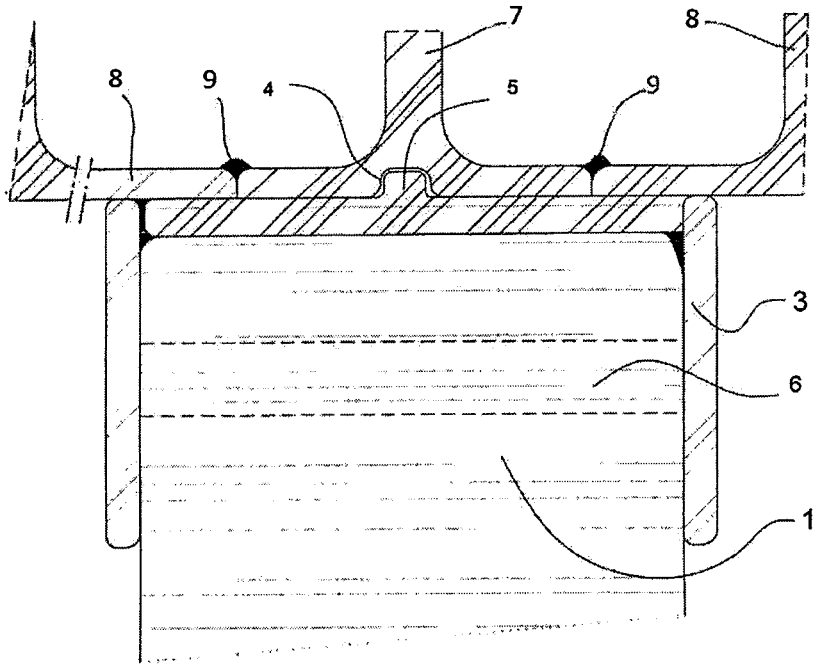
FIG. 3 shows a cross section of an alternate embodiment of a support wherein the locations of the rib and the groove are reversed.
Figure 4:
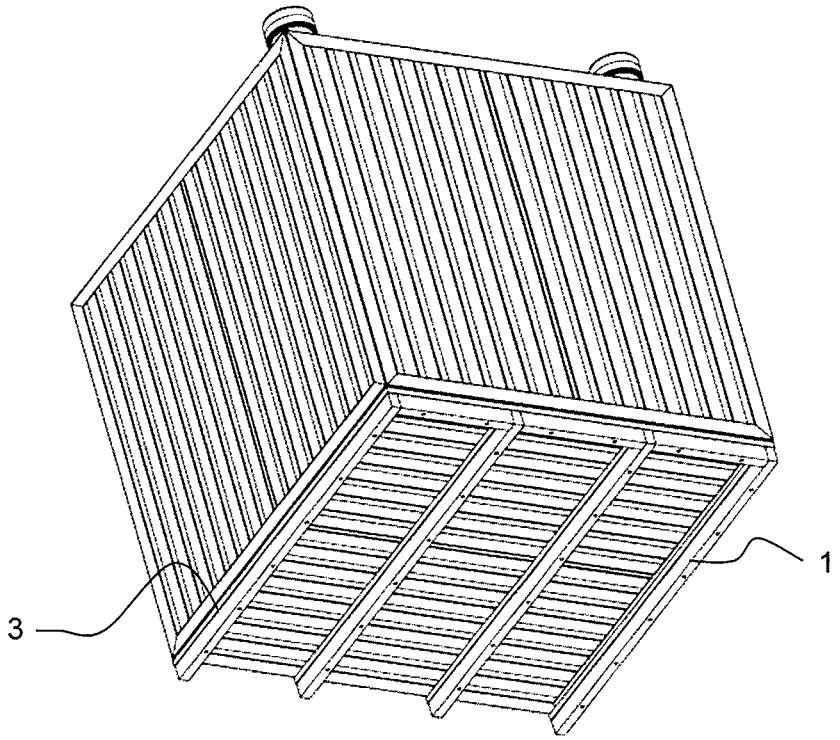
FIG. 4 shows an isometric drawing of a tank featuring supports on the bottom of the tank.

FIG. 3 shows a cross section of an alternate embodiment of a support wherein the location of the rib 5 and the groove 4 is reversed.

The invention claimed is:

1. A tank subjected to thermal expansion and contraction comprising a support arranged at the bottom of the tank, the support comprising a support block in contact with the bottom of the tank, movement prevention means for preventing movement of the tank with respect to said support block in a horizontal direction, said movement prevention means comprising a rib arranged in either said bottom of the tank or said support block, and a corresponding groove in the other of said bottom of the tank or said support block, wherein the bottom of the tank comprises first and second elements joined together by welds, whereof the first element rests on said support block and comprises said rib or said groove spaced from said welds by which the first element is joined to a pair of adjoining second elements.

2. The tank according to claim 1, wherein said rib is depending from said first element and is extending into the corresponding groove in said support block.

3. The tank according to claim 1, wherein said rib is extending from said support block into said groove in said first element.

4. The tank according to claim 1, wherein said rib or said groove is equally spaced from said welds to said adjoining second elements of the tank.

5. The tank according to claim 1, wherein said rib is a rolled or extruded part of said first element of the bottom of the tank.

* * * * *